US005428884A

United States Patent [19]

Tsuzuki

[11] Patent Number: 5,428,884

[45] Date of Patent: Jul. 4, 1995

[54] YARN CONDITIONING PROCESS

[75] Inventor: Kiyohiro Tsuzuki, Greenville, S.C.

[73] Assignee: TNS Mills, Inc., Greenville, S.C.

[21] Appl. No.: 274,483

[22] Filed: Jul. 13, 1994

Related U.S. Application Data

[60] Division of Ser. No. 192,997, Feb. 8, 1994, which is a continuation-in-part of Ser. No. 137,281, Oct. 14, 1993, Pat. No. 5,353,488, which is a continuation-in-part of Ser. No. 974,232, Nov. 10, 1992, Pat. No. 5,269,052.

[51] Int. Cl.[6] ..... B65H 54/00; F26B 5/04

[52] U.S. Cl. ..... 28/290; 28/285; 34/486; 34/497

[58] Field of Search ..... 28/285, 286, 290; 34/488, 497

[56] References Cited

U.S. PATENT DOCUMENTS

| | | | |
|---|---|---|---|
| 317,675 | 5/1885 | Russell . | |
| 1,629,167 | 5/1927 | Krantz | 28/285 X |
| 2,127,638 | 8/1938 | Brandwood | 34/16 |
| 3,070,948 | 1/1963 | Tsuzuki | 57/36 |
| 3,191,375 | 6/1965 | Naegeli | 57/164 |
| 3,469,385 | 9/1969 | Tsuzuki et al. | 57/34 |
| 3,564,829 | 2/1971 | Tsuzuki | 57/36 |
| 3,650,104 | 3/1972 | Shepherd et al. | 57/58.91 |
| 3,787,615 | 1/1974 | Foerster et al. | 178/66 P |
| 3,816,991 | 6/1974 | Takeuchi et al. | 57/36 |
| 4,022,077 | 5/1977 | Motobayashi et al. | 57/58.95 |
| 4,098,065 | 7/1978 | Stahlecker et al. | 57/58.95 |
| 4,150,053 | 4/1979 | Derichs | 57/263 |
| 4,497,168 | 2/1985 | Kamp | 57/401 |
| 4,590,683 | 5/1986 | Magin | 34/15 X |
| 4,590,757 | 5/1986 | Stahlecker | 57/412 |
| 4,607,485 | 8/1986 | Stahlecker | 57/401 |
| 4,922,707 | 5/1990 | Meroni et al. | 57/279 |
| 4,932,201 | 6/1990 | Meroni et al. | 57/408 |
| 4,939,895 | 7/1990 | Raasch et al. | 57/263 |

FOREIGN PATENT DOCUMENTS 2550017 5/1977 Germany .

*Primary Examiner*—John J. Calvert
*Attorney, Agent, or Firm*—Hardaway Law Firm

[57] ABSTRACT

An automated yarn conditioning apparatus and process is provided. This apparatus and process allows for unconditioned yarn packages to be brought from a source to a yarn conditioning station where they are conditioned and then ejected onto a takeaway conveyor. Yarn conditioning is achieved within an airtight chamber inside of a vessel. The yarn conditioning process used first evacuates the airtight chamber and then injects steam or other conditioning vapor into the airtight chamber while partially elevating the internal chamber pressure and/or temperature. Simultaneously with the conditioning of the yarn packages inside the airtight chamber, unconditioned yarn packages are brought to the conditioning station for placement inside the vessel when the prior conditioning step has been completed.

11 Claims, 8 Drawing Sheets

YARN CONDITIONING PROCESS

RELATED APPLICATION

This application is a divisional of pending application Ser. No. 08/192,997, filed Feb. 8, 1994; which is a continuation in part of application Ser. No. 08/137,281, filed Oct. 14, 1993, now U.S. Pat. No. 5,353,488; which is a continuation in part of application Ser. No. 07/974,232, filed Nov. 10, 1992, now U.S. Pat. No. 5,269,052.

BACKGROUND OF THE INVENTION

This invention is directed to an apparatus and process for conditioning yarn which has been previously wound on a cone, cheese, or similar package.

PRIOR ART

The cotton yarn spinning process necessarily imparts a high degree of line twist and tension during spinning. This tension is increased by winding the yarn on the cone or similar core.

A variety of apparatuses and processes are known in the art for conditioning yarn to set the yarn twist. Apparatuses using chemical conditioning and bulk heat setting have been employed to condition yarn. Apparatuses conditioning wool yarn with a combination of pressure and steam are also known in the art. However, such apparatuses and processes are often costly and inefficient in terms of processing times and energy requirements because these apparatuses and processes are usually labor intensive and lack the ability to be successfully employed in an automated assembly line setting. Further, such apparatuses and processes are not suitable for all types of yarn. Therefore, there is much room for improvement within the art.

SUMMARY OF THE INVENTION

It is an object of the present invention to provide an apparatus for conditioning yarn which enables continuous production and processing of yarn packages in an automated assembly line setting.

It is a further object of this invention to provide an apparatus for conditioning yarn which is energy efficient.

It is a further and more particular object of this invention to provide an apparatus for individually conditioning wound packages of yarn.

It is still a further and more particular object of this invention to provide an apparatus for conditioning wound yarn which includes individual monitoring of the wound package of yarn.

It is still a further object of this invention to provide a process for conditioning yarn in an automated assembly line setting.

These and other objects of the invention are provided by an apparatus and process for conditioning a yarn package to set twists therein, comprising:

providing a package of wound yarn;

placing the yarn package into a yarn conditioning chamber;

creating a first partial vacuum within the conditioning chamber;

introducing steam into the conditioning chamber;

increasing the pressure within the conditioning chamber by the introduction of the steam;

achieving a second partial vacuum pressure within the conditioning chamber;

maintaining the second partial chamber pressure until the yarn is set;

restoring ambient conditions within the chamber;

removing the yarn package from the conditioning chamber.

FIGS. *3a–3c* of the drawings are various views of a dome platform for use with the present invention.

FIGS. *4a–4d* of the drawings are various views of a ram mechanism in association with the rest of a yarn conditioning apparatus according to the present invention.

Figure 5:
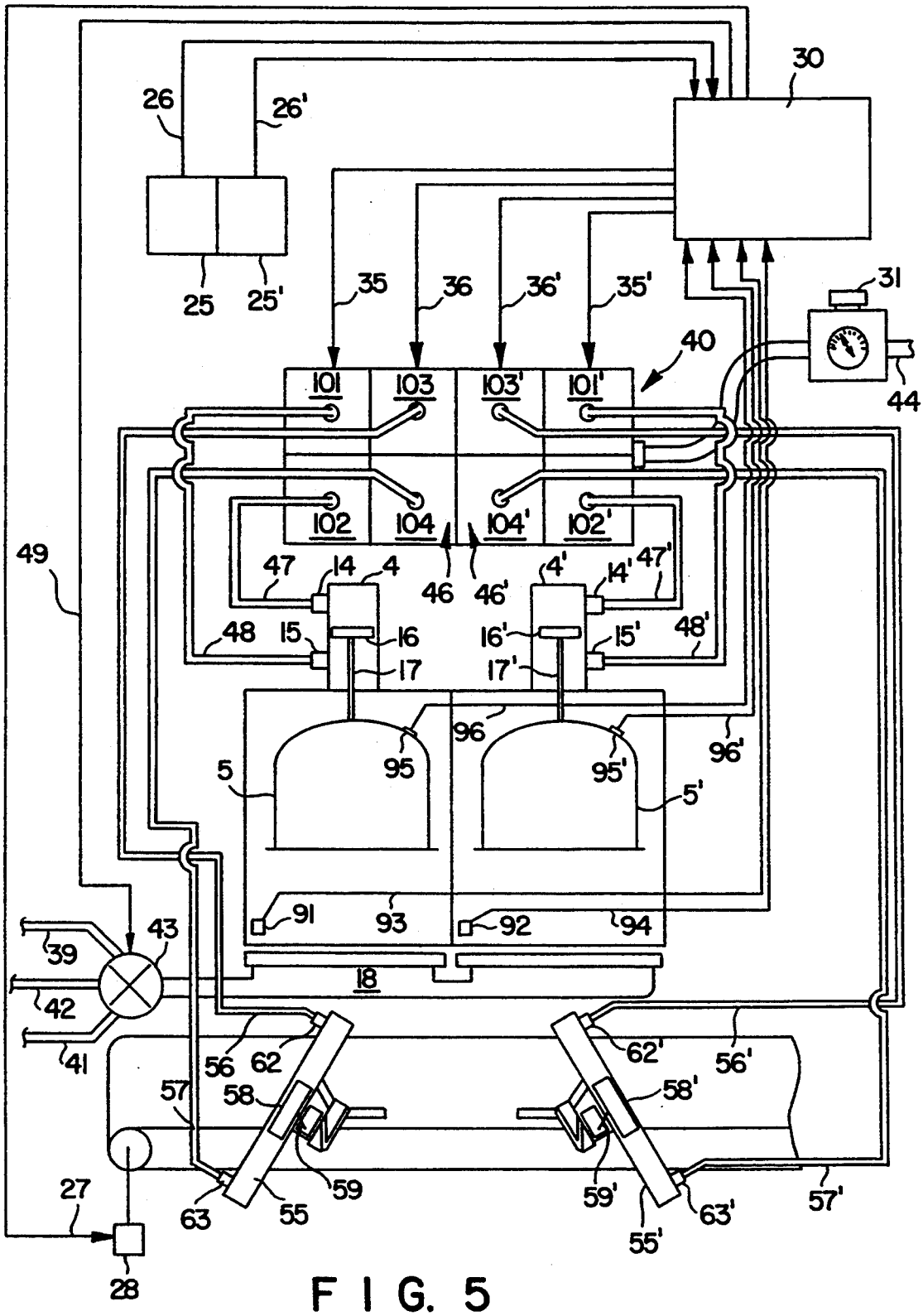

FIG. 5 of the drawings is a schematic for a yarn conditioning apparatus according to the present invention.

Figure 6:
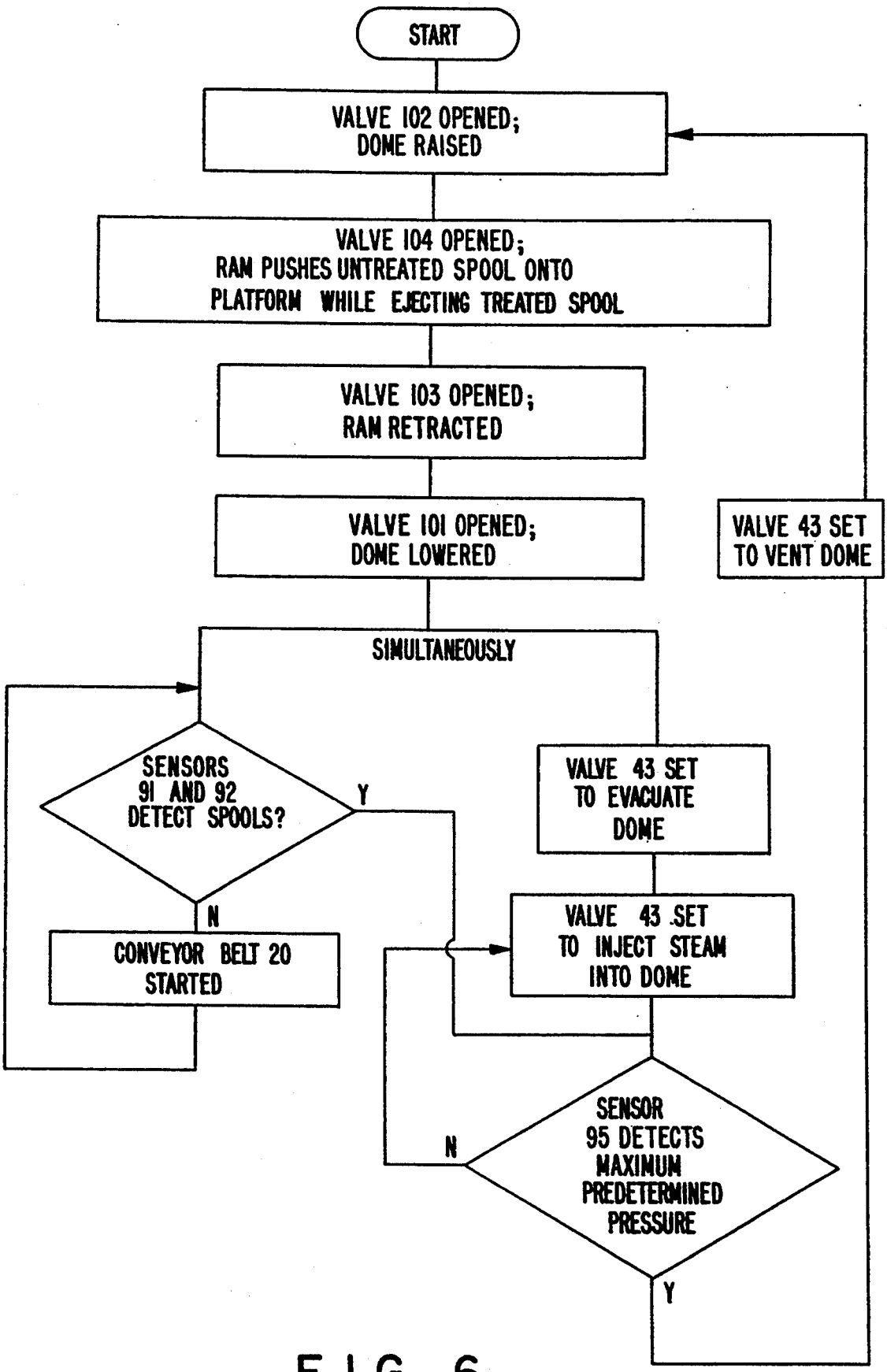

FIG. 6 of the drawings is a simplified flow chart representing the operation of the yarn conditioning apparatus.

Figure 7:
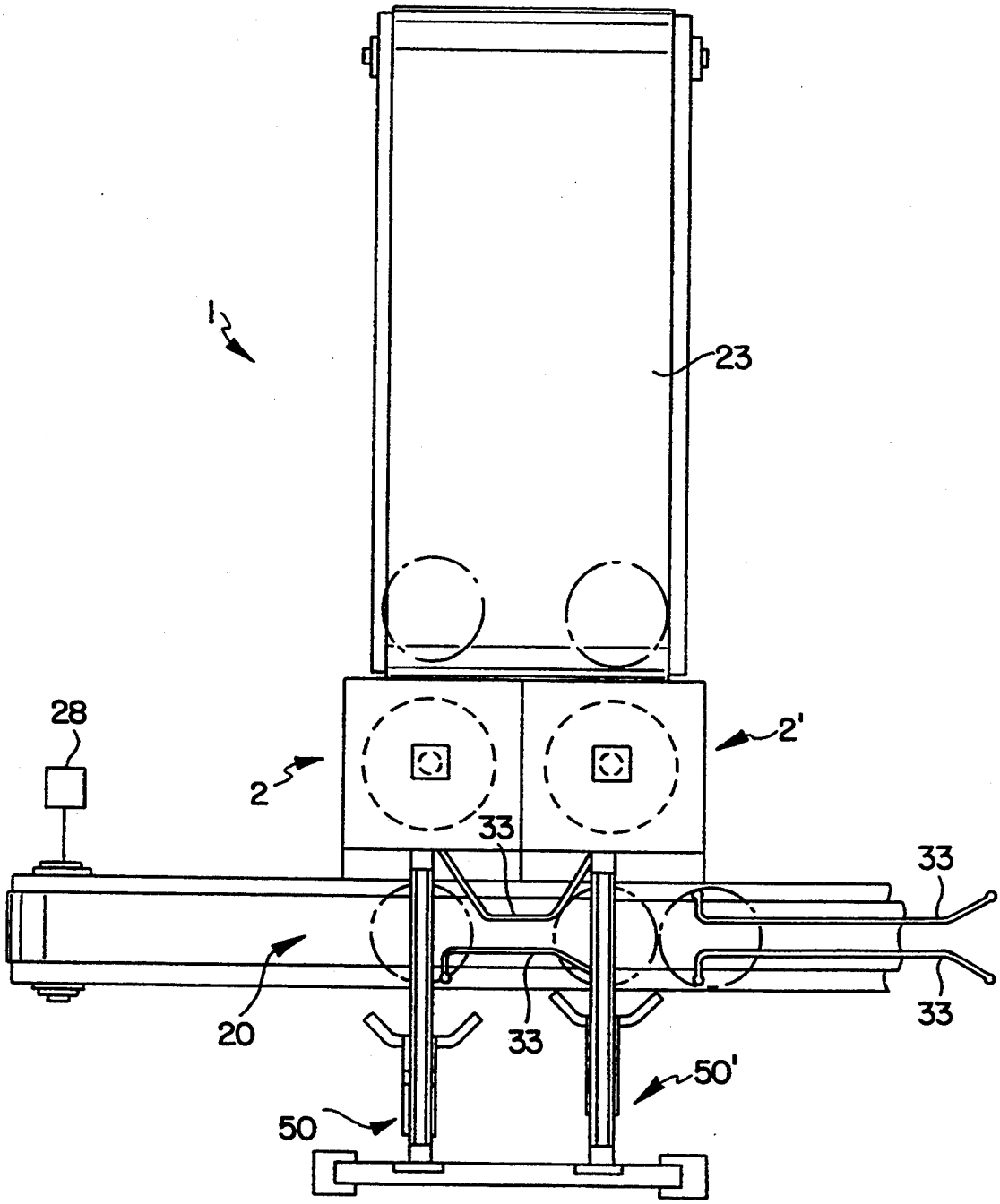

FIG. 7 of the drawings represents a simplified top view of the yarn conditioning apparatus according to the present invention with the plumbing lines omitted.

DETAILED DESCRIPTION

In accordance with this invention, it has been found that an efficient process and apparatus for conditioning yarn can be provided which utilizes individual treatment of yarn packages 21. A typical yarn package 21 is comprised of a central core 32 upon which cotton yarn is wound. The core is typically cardboard but may be constructed of any material resistant to the heat, pressure, temperature, and any chemicals used in the conditioning process. Such cores traditionally employ several shapes such as cones, cheeses, or cylinders.

The yarn possesses a twist as the result of the yarn spinning technique. It is therefore necessary to condition the yarn to set the twist and add moisture to assure that the yarn unwinds properly in subsequent uses.

While it is necessary that this yarn conditioning be carried out efficiently, it is also important that the automated setting of today's textile mills not be disrupted and thereby create increased labor costs. The present invention successfully balances these two concerns.

The yarn conditioning apparatus 1 of the present invention is made up of two identical yarn conditioning stations 2 and 2'. Because these two stations are identical, only one will be described. However, any reference numeral with a "'" after it will be the corresponding structure of the other yarn conditioning station.

I. General Structure

Frame 3 supports pneumatic cylinder 4 and encloses dome 5. Frame 3 has: a square top 6, four corner members 7 (the fourth corner not being shown), and four crossmembers 11 (the other two not being shown) connecting each set of adjacent corners. The two front corner members 7 have mounted thereon sensors 91 and 92 respectively. These sensors, which may be of any type, are used to detect when the yarn packages are properly positioned in between conditioning stations 2, 2' and ram 50.

Figure 1:
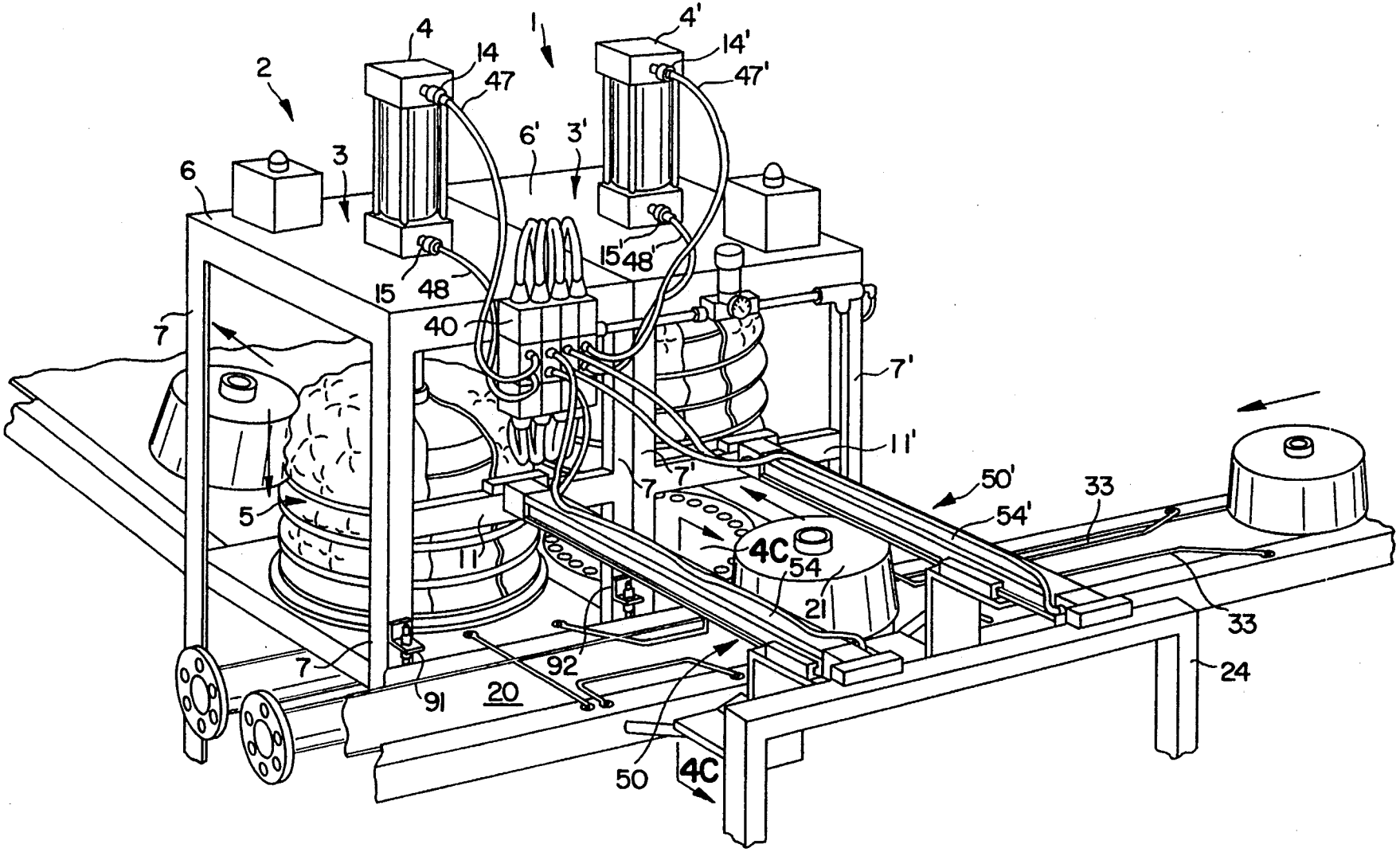
FIG. 1 of the drawings is a perspective view of a yarn conditioning apparatus according to the present invention.
Figure 4A:
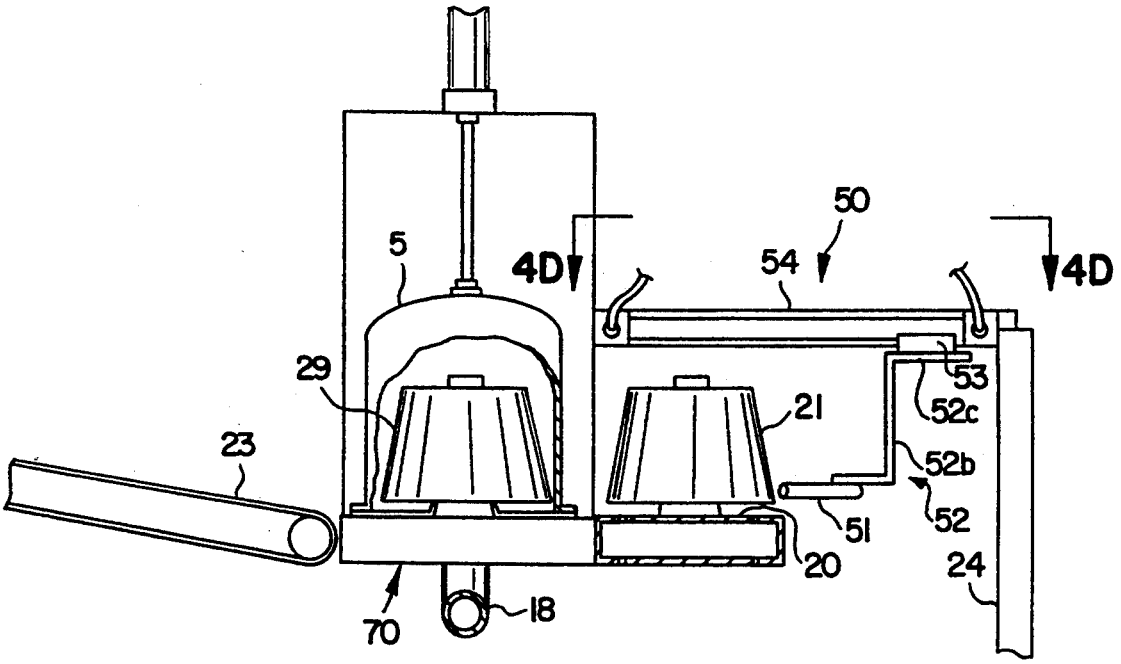
Figure 4B:
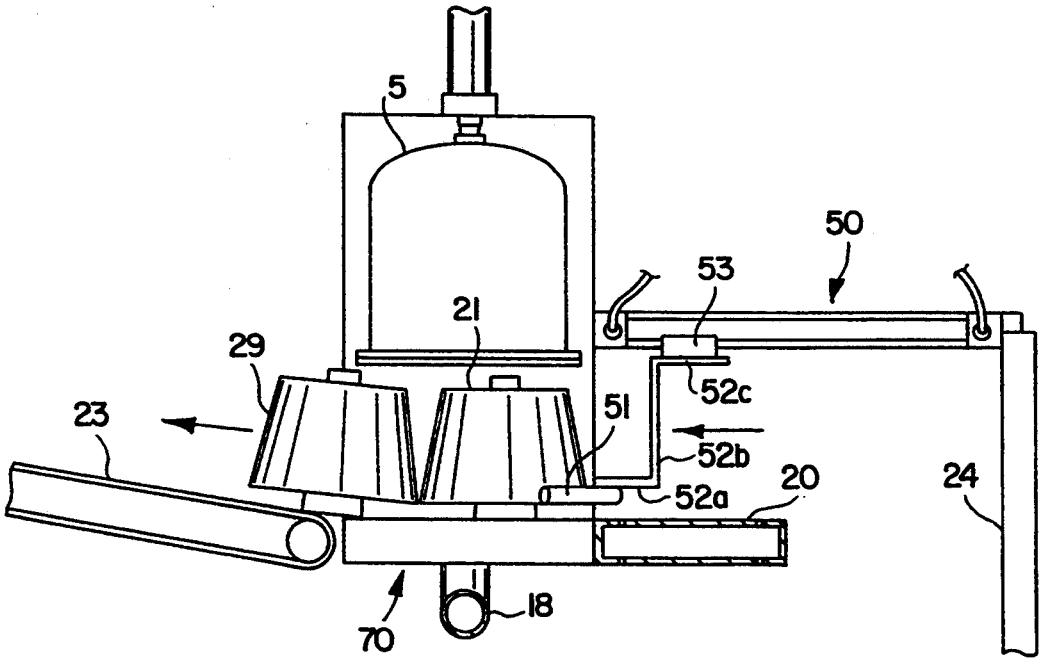
Figure 4C:
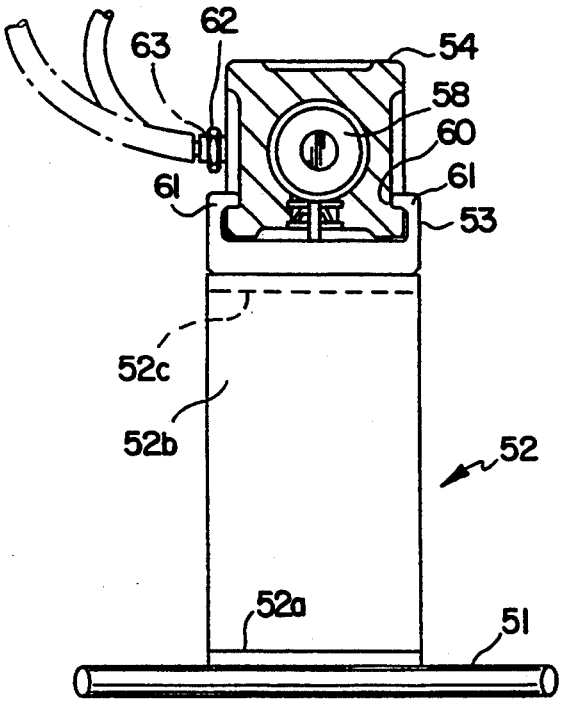

Immediately adjacent the front of yarn conditioning apparatus 1 passes a conveyor belt 20 driven by a motor 28 (See FIG. 5). This conveyor belt carries unconditioned yarn package 21 coming from a spinning machine such as an open end spinning machine and has multiple members 33 for directing the movement of the yarn packages 21. Passing over the conveyor belt 20 is a ram mechanism 50 using a conventional rodless cylinder 54, supported on one end by front crossmember 11 and on its other end by a support bracket 24. Ram mechanism 50, which will be described in more detail below, pushes unconditioned yarn packages off of conveyor 20 and onto the platform 70 and pushes conditioned yarn packages 29 off platform 70 and onto takeaway conveyor 23 (FIGS. 4*b* and 7). It should be noted that although FIG. 1 shows one dome up 5' and one dome down 5, this merely shows how the yarn conditioning apparatus looks during its various stages of preferred operation. It is also conceived that it is possible to completely synchronize the two yarn conditioning stations 2, 2'.

Figure 2:
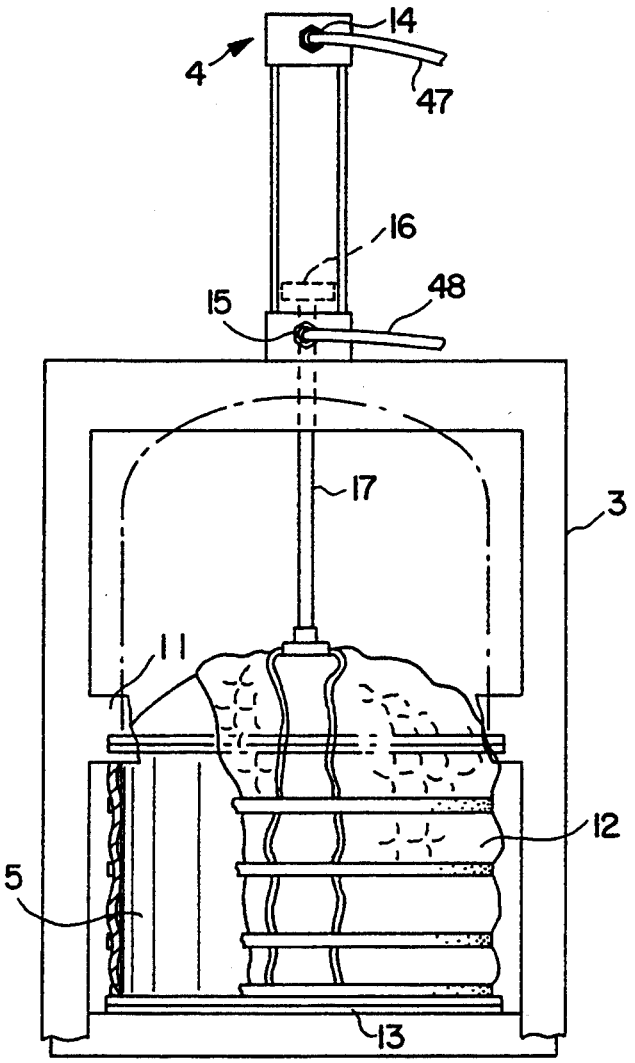
FIG. 2 of the drawings is a side elevation view, in partial cutaway, of a dome and a dome lifting mechanism for use with the present invention.

The dome 5 is shown in FIG. 2. Dome 5 is preferably made of cast iron or a type of steel such as stainless steel and wrapped with an insulating material 12. This insulating material protects the yarn conditioning apparatus' operator from being burnt since the inside of the dome and the dome itself will become very hot due to the hot steam injected therein as will later be described. The dome 5 has a gasket 13 along its bottom circumference. A motor, preferably in the form of a fluid operated cylinder 4, is used to raise and lower the dome 5. This cylinder has two fluid ports 14, 15 which are connected to fluid hoses 47 and 48 that come from control block 40 (see FIGS. 1 and 5). Within fluid operated cylinder 4 is a piston 16 between fluid ports 14, 15. Due to this piston placement, fluid operated cylinder 4, as well as all the fluid operated cylinders described herein are so called "doubleacting" cylinders. Piston 16 is mounted to a piston rod 17 which, itself, is fixed to the top of dome 5. Piston rod 17 passes through an unshown hole in frame top 6 in order to connect the piston 16 to the dome 5. While in the preferred embodiment the dome moves with respect to a dome platform 70, it is also conceived that the dome platform 70 may be moved with respect to the dome 5. Furthermore, any type of motor may be used in place of fluid operated cylinders 4.

Figure 3A:
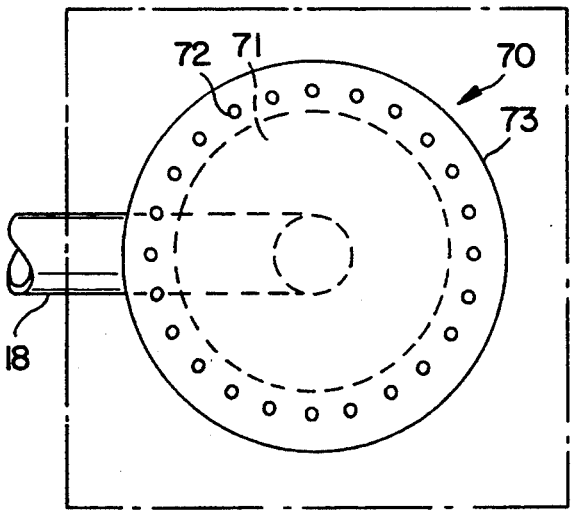
Figure 3B:
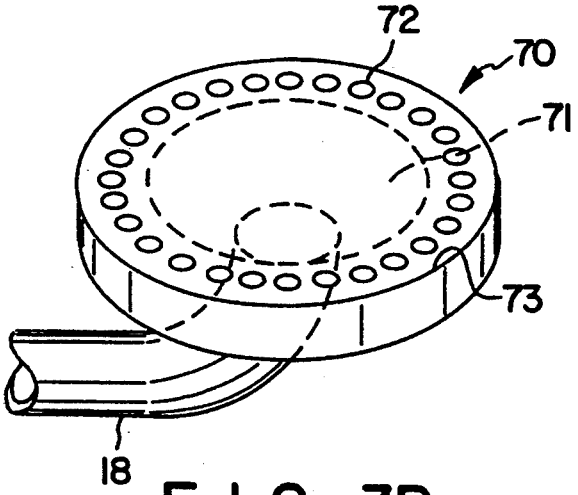
Figure 3C:
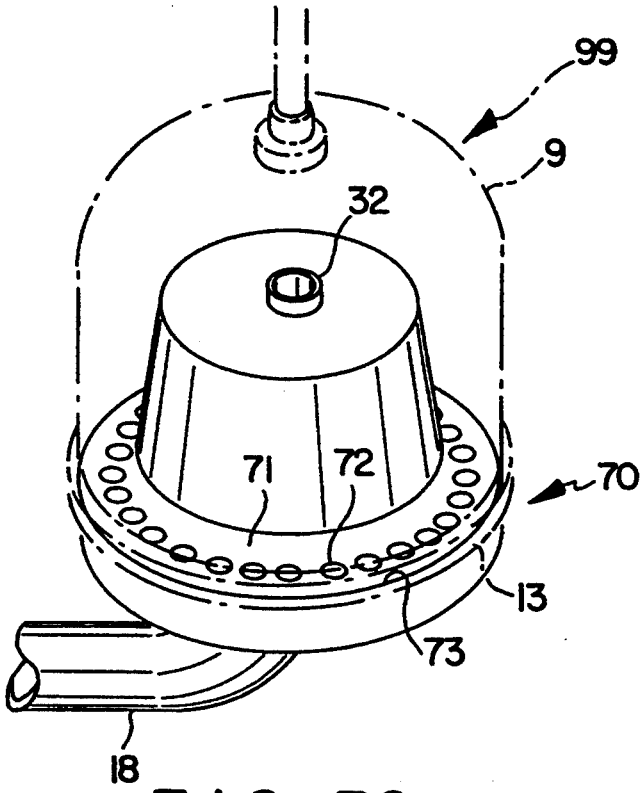

Dome platform 70 is shown in FIG. 3. Dome platform 70 not only supports a yarn package 21 that is to be conditioned but also, when the dome 5 with its gasket 13 is lowered, creates a pressure vessel 99 having an airtight chamber 9, as shown in FIG. 3*c*. Platform 70 is constructed out of steel and is of a hollow cylindrical shape. Dome platform top 71 has holes 72 close to the dome platform edge 73 and along its entire circumference. These holes are positioned close to the dome platform edge 73 so that when a yarn package is placed on the dome platform, the bottom of the yarn package will not cover or block any of these holes. This is shown in FIGS. 3*a* and 3*b* wherein the broken circle represents, in phantom, the bottom of a yarn package. FIG. 3*c* actually shows the position of the holes 72 with respect to dome 5 and yarn package 21. Finally, dome platform 70 has a vessel port line 18 in communication with holes 72. As seen in FIG. 5, this vessel port line allows for: (1) the evacuation of chamber 9 when port line 18 is connected to a source of vacuum 41, (2) the injection within chamber 9 of a conditioning vapor such as steam from a steam source 42, or (3) the passing of ambient air within chamber 9 by use of vent 39, depending on the position of selection valve 43. While selection valve 43 is shown as a three-way valve, it is well within the level of ordinary skill in the art for it selection valve 43 to consist of three separate valves, each in communication with port line 18.

Figure 4D:
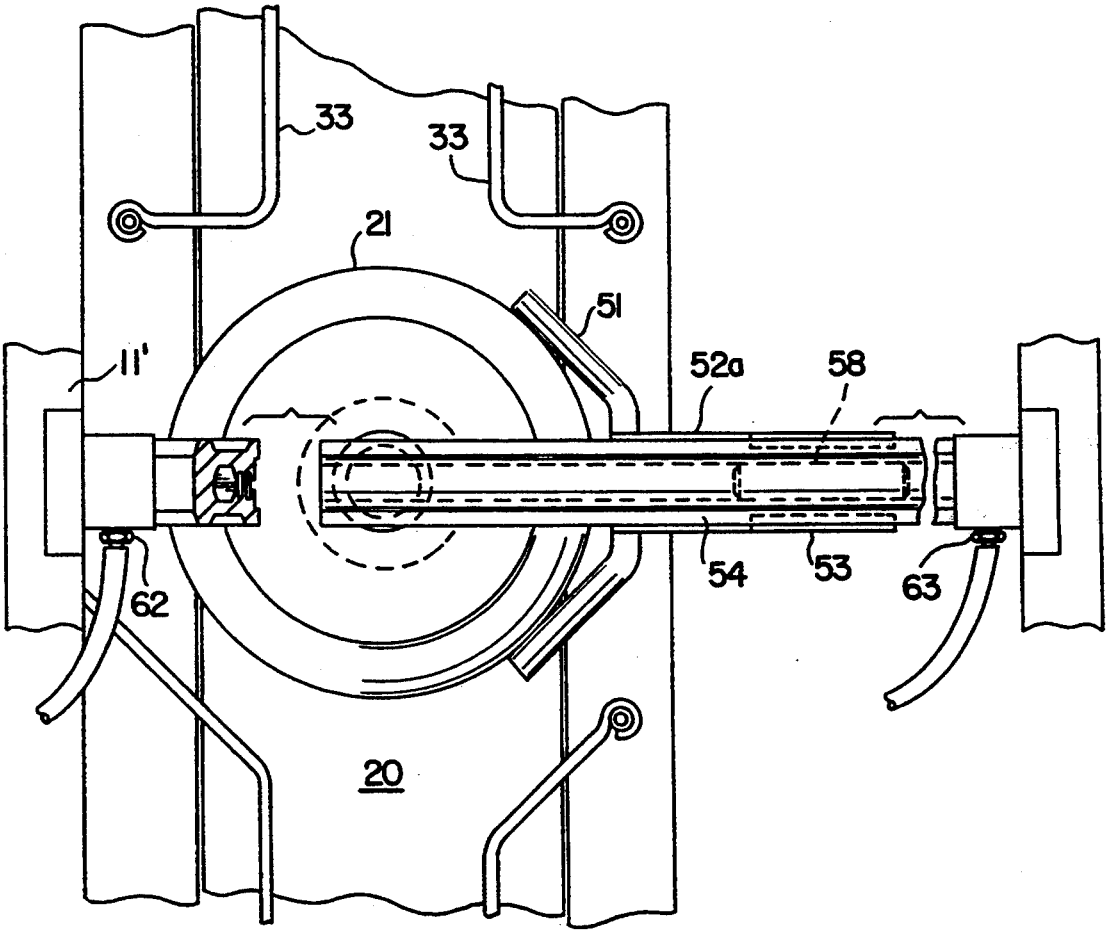

Ram 50 is shown in FIGS. 4*a*–4*d*. Ram mechanism 50 is supported by a conventional rodless cylinder 54 on one end to crossmember 11 and on its other end to support bracket 24. The ram mechanism has a generally "U" shaped pushing member 51. This pushing member 51 has sufficient space between its tines that a yarn package may fit within its open portion as shown in FIGS. 1 and 4*d*. Pushing member 51 is connected to carriage 53 by a connecting member 52. Connecting member 52 has three portions: a lower horizontal portion 52*a* which is connected to pushing member 51 at one end; vertical portion 52*b* which, at its bottom, is connected to the other end of lower horizontal portion 52*a*; and an upper horizontal portion 52*c* connected to both the top of the vertical portion 52*b* and carriage 53. Inside rodless cylinder 54 is a fluid operated motor having: fluid ports 62, 63 and a piston 58 connected to a part of carriage 53 by conventional means. Here too, any type of motor may be used in place of the rodless fluid operated cylinder. Elongations 61 of carriage 53 slide within grooves 60 on the outside of rodless cylinder 54.

The Control System

In describing the structure of the control system, reference will be made to FIG. 5. The entire yarn conditioning apparatus is controlled by a controller 30. This controller 30 can come in any form but is preferably a microprocessor based device. A source of power 44 is also provided. This one source of power is capable of operating all the motors of the preferred embodiment. While in the preferred embodiment this source of power is a source of pressurized fluid, preferably air, if, for example, electric motors are used in place of fluid operated cylinders, then this source of power would be a source of electricity. Through lines 35, 36, 35', 36', each of four segments 45, 46, 45', 46' respectively, of the control block 40 can be controlled by the con,roller 30. In the preferred embodiment the control block is a valve block. However, if a different source of power is used a switching means suitable for that source of power will be used. Each segment of the valve block 40 comprises two valves, i.e., segment 45 has valves 101 and 102 and segment 46 has valves 103 and 104.

Valves 102 and 101 of valve block segment 45 cause the up-down movement of dome 5, respectively. For upward dome movement controller 30 sends a signal along lead 35 to open valve 102 and close valve 101. Pressurized air coming from a source 44 into the valve block 40 is, therefore, sent through air line 48 and into the air port 15 of pneumatic cylinder 4. This pressurized air will push piston 16 in an upward direction along with its associated piston rod 17 which, because it is attached to dome 5, will cause the dome 5 to move upwardly. For downward dome movement controller 30 sends a signal along lead 35 to open valve 101 and close valve 102. Pressurized air coming from the source 44 into valve block 40 is now sent through air line 47 and into air port 14 of pneumatic cylinder 4. Now the pressurized air will push piston 16 in a downward direction along with its associated piston rod 17 which, because it is attached to dome 5, will cause the dome 5 to move downwardly. It should be noted that when reference is made to any of the valves being "closed" what is really meant is that pressurized air is not allowed to flow out of the valve block 40 via that valve. However, pressurized air is allowed to exhaust out of the pneumatic cylinder to the atmosphere via conventional means.

Valves 103 and 104 of valve block segment 46 cause the movement of the ram 50 away from and towards the conditioning station 2, respectively. Before the dome can be lowered, the ram must be moved away from the conditioning station 2 in order to allow for the proper clearance between the dome 5 and the pushing member 51. To move the pushing member 51 away from the conditioning station 2 in order to allow an unconditioned spool of yarn 21 to be properly positioned for insertion into the conditioning station 2, controller 30 sends a signal along lead 36 to open valve 103 and close valve 104. Pressurized air coming from the source 44 into valve block 40 is sent through air line 56 and into air port 62 of rodless cylinder 54. The pressurized air will push piston 58 away from yarn conditioning station 2, which because the piston 58 is attached to pushing member 51 through connecting member 52 and the carriage 53, will cause the pushing member to move away from the conditioning station 2. To move the pushing member 51 towards the conditioning station 2 in order to push an unconditioned yarn package 21 into the conditioning station 2 and eject an already conditioned yarn package 29 out of conditioning station 2 and onto takeaway conveyor 23, controller 30 sends a signal along lead 36 to open valve 104 and close valve 103. Pressurized air coming from the source 44 into valve block 40 is sent through air line 57 and into air port 63 of rodless cylinder 54. The pressurized air will push piston 58 towards yarn conditioning station 2 which, because the piston 58 is attached to pushing member 51 through connecting member 52 and carriage 53, will cause the pushing member 51 to move towards the conditioning station 2. The pressure of the air entering valve block 40 can be adjusted by regulator 31.

As previously described, conventional sensors 91 and 92 detect when the unconditioned yarn package 21 is properly positioned in between yarn conditioning stations 2, 2' and rams 50, 50'. To achieve this end, sensors 91 and 92 are connected to controller 30 through leads 93 and 94 respectively. Thereby, the controller 30 knows when to activate the ram 50 and insert the unconditioned yarn package 21 in to conditioning station 2.

Selection valve 43 is controlled by controller 30 via lead 49. Controller 30 will first send a signal along lead 49 to set the selection valve 43 so that the vacuum source 41 is in communication with the vessel port line 18 and port holes 72 until an internal pressure of 650 mm Hg below atmospheric is achieved within the airtight chamber 9 as detected by the sensor 95. Then, controller 30 will send a signal along lead 49 to set the selection valve 43 so that the steam source 42 is in communication with the vessel port line 18 and port holes 72. 0.25 $Kg/cm^2$ steam (low temperature steam) is injected into the airtight chamber 9 until sensor 95 detects the predetermined pressure of 380 mm Hg below atmospheric. At this point, the introduction of low temperature steam raises the temperature within airtight chamber 9 to about 140° F. At that point selection valve 43 will close the steam source 42 off from the port inlet 18. 0.5 seconds later, ambient air will be passed through airtight chambers 9,9' for about 3 seconds by setting the selection valve 43 so as to use vent 39 to place the ambient atmosphere in communication with vessel port line 18 to cool the conditioned yarn packages 29,29' and, more importantly, bring the sub-atmospheric pressure within the airtight chamber to an atmospheric level in order to allow for the easier opening of the vessel. Any excess condensation is drained out of the system by use of a conventional non-shown condensate valve that opens simultaneously with the closing of the vent. Finally, controller 30 will cause the dome 5 to raise, and the airtight chamber 9 will be opened. There is no danger of an operator being burnt by the hot steam that was injected into the airtight chamber 9 because although most of this steam is absorbed by the yarn package during the conditioning process, any excess steam will be released through either the vent line during the venting step or the condensate valve.

On an inside surface of dome 5 is a pressure sensor 95. This sensor is connected to controller 30 by lead 96. This sensor operates such that while a yarn package is being conditioned within airtight chamber 9, it senses the pressure within the chamber 9 and sends that value to the controller 30. When it is detected that the pressure within the chamber 9 has reached atmospheric pressure as described above, the controller causes the dome to be raised because the conditioning has been completed.

Finally, an emergency dome lift switch 25 is provided. In case of an emergency this switch can be activated sending a signal along line 26 to the controller 30. Controller 30 will then cause the domes to be moved upwardly regardless of what point in the yarn conditioning operation yarn conditioning station 2 is currently engaged.

The above operating conditions of temperature, time, and pressure are given in reference to wound spools of cotton yarn. The use of non-cotton fibers such as wool, mixed content yarns, synthetic yarns, variable or different package sizes, as well as prior coatings or treatment of the yarn, could cause variation in the optimal operating conditions. However, the ability to supply a first partial vacuum, followed by the introduction of low temperature conditioning vapor which results in a second partial vacuum, and subsequently maintaining the second vacuum until the yarn is cured (on the range of 10 seconds or less) is a vast improvement in time and energy requirements of the prior art. In addition, worker safety is improved by avoiding high pressure and high temperature steam as well as the exposure hazards of prior art chemical conditioning.

As used in this application, the term "low temperature steam" or "vapor" refers to a steam or vapor source which is below the vapor point temperature the steam or vapor would have at normal atmospheric pressure. Therefore, in the example above for steam, the introduction of the steam into the partially evacuated conditioning chamber allows the vapor to be introduced at approximately 140° Fahrenheit as opposed to the 212° Fahrenheit or higher temperatures typically associated with atmospheric steam or pressurized steam in reference to atmospheric conditions. It is envisioned that a variety of different pressure and vapor temperature combinations can be employed. Any partial vacuum setting which permits the rapid diffusion of the introduced vapor and subsequently removal of any excess will suffice.

While a preferred temperature and pressure for low temperature steam used for treating cotton yarn is given above, it is understood and appreciated by those having ordinary skill in the art that the temperature and pressure conditions of the low temperature steam can be adjusted for differences in yarn composition and yarn package sizes. For instance, a less efficient, slower treatment process could be adopted where cooler steam is employed for a longer treatment time. Such variations fall within the scope of the present invention as claimed below.

Since a combination of water vapor and temperature is involved in conditioning the yarn, steam is an ideal mechanism for achieving the required conditions. However, vapor and heated air could be introduced into the conditioning chamber through separate valves 43. Also a conditioning vapor, such as water, could be supplied into the partially evacuated conditioning chamber by an ultrasonic humidifier or other misting apparatus. Prior to the introduction of vapor, the temperature of the conditioning chamber could be raised by any conventional heating apparatus or source. Therefore, when the vapor is introduced into the heated, partially evacuated chamber, the vapor temperature is elevated along with the chamber pressure. This creates the necessary vapor/pressure/temperature conditions for treating the yarn. Upon evacuation of the chamber, heated, ambient air can be passed through the chamber to remove any excess moisture from the yarn.

The above processes and apparatus is not limited to water vapor or steam conditioning, i.e., "setting", treatments. Chemical vapor treatment of yarn packages can also be carried out by introducing chemical additives in place of, or in conjunction with, the steam or vapor. The partial vacuum in the conditioning chamber helps to rapidly diffuse and distribute the conditioning vapor about the yarn. In addition, the drying of any excess conditioning moisture or vapor residue is facilitated by the restoration of ambient conditions, which may include a separate drying or cooling step. The ability to rapidly and individually treat yarn packages is an important development in the art of conditioning yarn.

Operation of the Yarn Conditioning Apparatus

FIG. 6 shows a simplified flow chart representing the operation of the yarn conditioning apparatus. It should be noted that this flow chart starts with the assumption that an unconditioned yarn package 21 is already properly positioned in between the conditioning station 2 and the ram 50 and conditioned yarn package 29 is within chamber 9 of vessel 99 (FIG. 4*a*).

1. Controller 30 causes valve 102 to be opened and the dome will be lifted as described above in order to open the vessel 99. At the very moment gasket 13 is lifted off the dome platform 71 the condition within airtight chamber 9 will be brought to the condition of the ambient atmosphere.
2. Controller 30 causes valve 104 to be opened and, therefore, pushing member 51 will move towards conditioning station 2. This will cause unconditioned yarn package 21 to be pushed off conveyor 20 and onto dome platform 70. This new yarn package will simultaneously push the conditioned yarn package 29 off the platform 70 and onto takeaway conveyor 23 for, e.g., inspection or packaging.
3. Controller 30 causes valve 103 to be opened and, therefore, pushing member 51 will move away from conditioning station 2.
4. Controller 30 causes valve 101 to be opened and the dome 5 with gasket 13 will be lowered onto the dome platform 70, closing vessel 99 and creating the airtight chambers 9.
5. The following two steps occur simultaneously.

5*a*. Controller 30 checks lead 93 to determine whether a new unconditioned yarn package 21 is positioned in front of the conditioning station 2. If not, a signal is sent along lead 27 to conveyor 20's motor 28 to remain on. Then, when it is determined that a new unconditioned yarn package 21 is properly positioned in front of the conditioning station 2, controller 30 sends a signal along lead 27 to stop motor 28.

5*b*. Controller 30 positions selection valve 43 so as to cause the evacuation of airtight chamber 9 to an internal pressure of about 650 mm Hg below atmospheric. When this internal pressure is achieved, controller 30 positions selection valve 43 so as to allow 0.25 $Kg/cm^2$ steam to be injected into airtight chamber 9 until a pressure of 380 mm Hg below atmospheric is detected by sensor 95. At this point, the internal temperature within the airtight chamber 9 should be about 140° F. and the selection valve 43 will close the steam source 42 off from the inlet port 18. 0.5 seconds later, selection valve 43 is set so as to pass ambient air through the airtight chamber for 3 seconds by placing the vent line 39 in communication with port line 18. Then controller 30 will cause the vessel to be opened by lifting the dome and the process will be repeated.

It should be noted that multiple chambers can be opened in synchrony or independently of each other. If desired, the temperature and/or moisture levels of the air flow can be monitored to insure that the conditioned yarn package 29 is sufficiently cool and dry for subsequent handling.

The optimal temperature for the conditioning interval of cotton yarn is between 130°–140° F., the temperature being correlative to the pressure of the steam supplied from source 42. Higher temperatures run a risk of damaging some yarns while lower temperatures are either less effective or require a longer exposure interval. However, for any given type of yarn, optimal conditions for the recited pressures and temperatures can be expected to vary.

For example, heat tolerant yarn could be conditioned as described above by the introduction of high temperature steam. Under these conditions, the high temperature steam is used to provide the second partial vacuum/pressure. The partial pressure within the conditioning chamber facilitates the diffusion of the conditioning steam. The remainder of the process then proceeds as described above.

The preferred conditioning process carried out by the apparatus uses low temperatures and reduced pressure which does not weaken or damage delicate yarns. The conditioning process is safe for dyed yarn and does not shrink or otherwise alter the desired yarn characteristics. Further, because the conditioning apparatus is fully automated, it does not disrupt the sequential assembly steps desired in supplying the finished yarn product. The yarn is wound, conditioned, and packaged in an incremental, individual fashion. Therefore, the conditioning apparatus does not require removal of the yarn packages for bulk handling or conditioning. In addition, energy and time savings are realized in that the continuous flow of the assembly line is not interrupted. Individual conditioning of yarn packages in appropriately sized containers also lessens the energy cost of providing the low pressure and low temperature steam used in the conditioning process. Substantial time and energy savings are thus realized over other conditioning apparatuses which condition yarn supplies in bulk.

It is also well-known in the art that by varying the physical properties of the incoming steam different operating conditions can be accommodated. It is a well established physical property that the lower a pressure the lower the vapor point temperature at which steam can be produced. Therefore, the second partial vacuum and its corresponding vapor point temperature provide a simple control mechanism for adjusting and optimizing the yarn conditioning process.

It should be recognized and appreciated by those having ordinary skill in the art that the above process and apparatus is described with references to a conditioning condition, described as a conditioning pressure, achieved by introducing low temperature steam into a fixed volume, for setting cotton yarn. Because steam temperature and pressure are correlated according to the ideal gas law ($PV=nRT$), the identical conditioning process could be carried out with reference to a conditioning condition, described as a conditioning temperature, achieved by using low temperature steam to result in the conditioning temperature. Such use is equivalent because, for a fixed volume and number of moles, a volume, in response to the introduction of a fixed amount of constant temperature steam, will always have the same temperature and pressure. Therefore, the conditioning condition can be defined by either its pressure or temperature because they are merely two ways of describing the same condition. Thus, the conditioning conditions could be expressed either in terms of pressure, or the pressure's equivalent corresponding temperature value; either way the conditioning conditions being achieved through the introduction of low temperature steam. Either form of reference is an equivalent manner of describing the conditioning conditions or how the process is carried out.

The above description is given in reference to a yarn conditioning apparatus for setting yarn which has been wound onto spools. However, it is understood that many variations are apparent to one of skill in the art from a reading of the above specification and such variations are within the spirit and scope of the instant invention as defined by the following appended claims.

That which is claimed:

1. A process of setting yarn twist comprising:

introducing a quantity of yarn into a sealable container;

creating a first partial vacuum within said container;

elevating the temperature within said container;

introducing a conditioning vapor into said container while said container is at said elevated temperature;

restoring ambient conditions to said container;

removing said quantity of yarn.

2. The process according to claim 1 further comprising the step of:

passing a stream of heated air through said conditioning chamber after said step of restoring ambient conditions to said container.

3. The process according to claim 1, wherein said step of elevating the temperature comprises creating a temperature of about 130°–140° F. in said conditioning chamber.

4. The process according to claim 1, wherein said step of elevating the temperature is carried out using a heating apparatus.

5. A process for conditioning an individual yarn package comprising:

providing a yarn package having an unwanted property in the wound yarn;

placing said yarn package into a yarn conditioning chamber having a first internal temperature;

introducing a conditioning vapor into said conditioning chamber until a second internal temperature is achieved within said conditioning chamber;

maintaining said second internal temperature for less than about 15 seconds until said unwanted property is eliminated;

restoring ambient conditions to said chamber;

removing said yarn package from said conditioning chamber.

6. The process according to claim 5, further comprising the step of substantially stopping the introduction of conditioning vapor into said conditioning chamber before the step of maintaining said second temperature.

7. The process according to claim 5, wherein during said step of maintaining, said conditioning chamber is substantially sealed and no vapor either enters of leaves said conditioning chamber.

8. The process according to claim 5, wherein said step of maintaining lasts about 10 seconds.

9. An automated process for conditioning individual yarn packages comprising:

providing a yarn conditioning chamber;

conveying an individual yarn package having an unwanted property in the wound yarn to said conditioning chamber having a first internal temperature;

placing said individual yarn package into said yarn conditioning chamber;

introducing steam into said conditioning chamber until a second internal temperature is achieved within said conditioning chamber;

maintaining said second internal temperature until said unwanted property is eliminated;

restoring ambient conditions to said chamber;

removing said individual yarn package from said conditioning chamber.

10. A process for conditioning an individual yarn package comprising:

providing a yarn package having an unwanted property in the wound yarn;

placing said yarn package into a yarn conditioning chamber;

creating a first temperature within said conditioning chamber;

increasing said temperature within said conditioning chamber by the introduction of said steam until a second temperature is achieved;

maintaining said second temperature until said unwanted property is eliminated;

restoring ambient conditions to said chamber;

removing said yarn package from said conditioning chamber.

11. The process according to any one of claims 1, 5, 9 or 10, wherein said unwanted property of said yarn package is unwanted twist in the wound yarn.

* * * * *